US006695661B1

(12) United States Patent
Navagh

(10) Patent No.: US 6,695,661 B1
(45) Date of Patent: Feb. 24, 2004

(54) WINDSURFING BOARD VENT PLUG WARNING DEVICE

(76) Inventor: John Timothy Navagh, 425 Sierra St., Apt. 8, El Segundo, CA (US) 90245

( * ) Notice: Subject to any disclaimer, the term of this patent is extended or adjusted under 35 U.S.C. 154(b) by 0 days.

(21) Appl. No.: 10/222,161

(22) Filed: Aug. 19, 2002

(51) Int. Cl.[7] ..... B63B 35/79
(52) U.S. Cl. ..... 441/74; 114/39.12
(58) Field of Search ..... 441/74; 114/39.12, 114/39.14

(56) References Cited

U.S. PATENT DOCUMENTS 5,381,747 A * 1/1995 Hinde ..... 114/39.16

FOREIGN PATENT DOCUMENTS

DE 33 33 300 C1 * 2/1985

* cited by examiner

*Primary Examiner*—Sherman Basinger

(57) ABSTRACT

A device installed in the vent hole of a windsurfing board to warn the user that the vent plug is not installed, and the board should not be placed in the water. Additionally, the device has a container for holding the vent plug when it is not installed in the board, thus preventing loss or misplacement of the plug. Also, the device contains a tool for installing and removing the vent plug before and after the use of the invention, thus making it very convenient to use the invention.

6 Claims, 1 Drawing Sheet

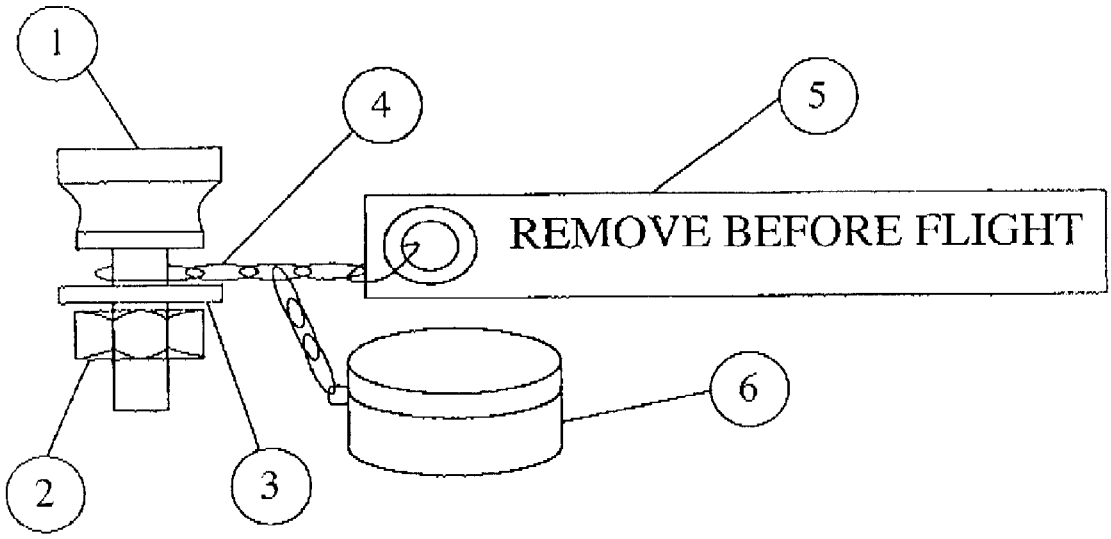
1
4
5
REMOVE BEFORE FLIGHT
6
2
3

WINDSURFING BOARD VENT PLUG WARNING DEVICE

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

This invention relates to a device which, when installed in a windsurfing board, will warn the user that the vent plug for the board has not been installed and tightened, thus preventing the unintentional submersion of the unsealed board in the water. The applicant knows no particularly pertinent prior art.

BRIEF SUMMARY OF THE INVENTION

Many windsurfing boards produced today are made with a vent hole and plug. The vent hole allows air to escape from the board, thus preventing the board from cracking due to internal pressure. This pressure can be created when the board is taken from a low altitude to a higher one, such as during transportation in an airplane, or during a drive over the mountains. Pressure can also build up when the board is left out in the sun, and any air in the board heats up and expands. For this reason, the vent plug is generally removed from the board during transportation, and also if the windsurfer is taking a break, and the board will be out of the water for some amount of time. A problem occurs, however, if the windsurfer forgets to reinstall the vent plug before putting the board in the water. When this happens, some amount of water will enter the board, and be absorbed into the foam core of the board. If very much water enters the board, it can be ruined. If only a little water gets in, the board may eventually dry out and still be usable, but it is likely that it will not perform as well as it had ever again.

The objective of this invention is to make it less likely that a windsurfer will take a windsurfing board into the water before installing and tightening the vent plug. The invention consists of a nylon thumb screw which threads into the existing vent hole on a windsurfing board after the vent plug has been removed. Attached to this nylon thumb screw is a brightly colored ribbon, making it obvious to the user that the vent plug is not installed. Additionally, the invention has a plastic container that will hold the vent plug while the warning device is installed in the board, thus preventing loss or misplacement of the vent plug. Also, the invention includes a tool that is stored in the plastic container for removing and installing the vent plug before and after the use of the invention, thus making it very convenient to use the device.

BRIEF DESCRIPTION OF THE SEVERAL VIEWS OF THE DRAWING

One view of the invention is attached. It shows the nylon thumb screw (item 1) on the left. A nylon nut (item 2) and a nylon washer (item 3) are used to hold the chain (item 4) on the thumb screw. The chain (item 4) is used to hold the ribbon (item 5) and the plastic container (item 6) to the thumb screw. The ribbon (item 5) warns the user that the vent plug is not installed, and that the board should not yet be placed in the water. The tool for installing and removing the vent plug is a small screwdriver stored in the container (item 6), and is not shown in the FIGURE.

DETAILED DESCRIPTION OF THE INVENTION

The thumb screw (item 1) is sized so as to fit into the vent hole of a windsurfing board. Most windsurfing boards produced today have either a ⅜–16 or a 10–32 sized vent hole plug. So, a thumb screw of either of these sizes is used. The thumb screw is about 1 inch in length. Any size thumb screw could be used to accommodate any other size vent hole in a particular board.

The nylon nut and washer (items 2 and 3, respectively) are sized according to the size of the thumb screw (item 1). The nut is epoxied into place to hold the assembly together during use.

The metal chain (item 4) is made of a non-corrosive material, so it will not rust after getting wet and being outdoors. It is about 1 or 2 inches in length.

The ribbon (item 5) is made of a durable, weatherproof material such as nylon. It can be imprinted with a phrase such as "Remove Before Sailing", "Remove Before Flight", or "Remove Before Hauling Ass" (a common windsurfing expression). Any other appropriate phrasing can be imprinted on the ribbon.

The container (item 6) is a plastic container, typically used as a pillbox. It has a hinged lid which be attached easily to the chain (item 4). It is about 1.5 inches in diameter and 0.5 inch deep. It is large enough to hold the vent plug for the board, and a small "L" shaped screwdriver, which is used to install and remove the vent plug.

The use of the device is quite simple. With the board out of the water, the vent plug is removed. This can be done with the tool in the plastic container of the device. The vent plug is placed in the container along with the tool, and the lid of the container snapped shut. The device is then threaded into the vent hole of the board. The thumb screw is made hand tight, allowing air to escape and preventing any pressure build up in the board. The board is now ready for transportation or to be left in the sun.

When ready to use the board in the water, the device is removed by unscrewing the thumbscrew. The vent plug is removed from the container, and reinstalled in the vent hole. The vent plug is tightened with the tool, and the tool is placed back in the container. The device can now be put away, ready to be used when the windsurfer comes out of the water.

I claim:

1. A device for indicating that a plug used in a vent hole of a sailboard has been removed and is not installed, said device comprising:

a thumbscrew a washer a chain, said chain being attached to said screw a nut for holding said washer and said chain assembled to said screw a ribbon, said ribbon being attached to said chain a container, said container being attached to said chain;

and wherein said thumbscrew is inserted into the vent hole of said sailboard after said plug has been removed and is not installed.

2. The device of claim 1 wherein said screw, said nut, and said washer are made of nylon.

3. The device of claim 1, wherein said ribbon is brightly colored, is made of nylon and has imprinted thereon a reminder that said plug has been removed and is not installed.

4. The device of claim 1 wherein said chain is made of non-corrosive metal.

5. The device of claim 1 wherein said container has stored therein a tool for removing and installing said plug.

6. The device of claim 1 wherein said container is adapted to store said plug when it has been removed and is not installed and is adapted to store said screw, nut, washer, chain, and ribbon when said screw is not installed in said vent hole.

* * * * *